US009611599B1

(12) United States Patent
Dyke et al.

(10) Patent No.: US 9,611,599 B1
(45) Date of Patent: Apr. 4, 2017

(54) GUARDRAIL CRASH ABSORBING ASSEMBLY

(71) Applicant: LINDSAY TRANSPORTATION SOLUTIONS, INC., Omaha, NE (US)

(72) Inventors: Gerrit A. Dyke, Stockton, CA (US); Joseph Martin Sicat, Pleasanton, CA (US)

(73) Assignee: Lindsay Transportation Solutions, Inc., Omaha, NE (US)

( * ) Notice: Subject to any disclaimer, the term of this patent is extended or adjusted under 35 U.S.C. 154(b) by 0 days.

(21) Appl. No.: 14/957,895

(22) Filed: Dec. 3, 2015

(51) Int. Cl.
*E01F 15/14* (2006.01)
*E01F 15/04* (2006.01)

(52) U.S. Cl.
CPC ..... *E01F 15/143* (2013.01); *E01F 15/04* (2013.01); *E01F 15/146* (2013.01)

(58) Field of Classification Search
CPC . E01F 15/00; E01F 15/02; E01F 15/04; E01F 15/0407; E01F 15/0423; E01F 15/043; E01F 15/145; E01F 15/146
See application file for complete search history.

(56) References Cited

U.S. PATENT DOCUMENTS 4,330,106 A 5/1982 Chisholm
4,352,484 A * 10/1982 Gertz ..... E01F 15/146 104/254
4,655,434 A 4/1987 Bronstad
4,739,971 A 4/1988 Ruane
4,838,523 A 6/1989 Humble et al.
5,851,005 A 12/1998 Muller et al.
6,554,256 B2 * 4/2003 Ochoa ..... E01F 15/143 256/13.1
6,811,144 B2 11/2004 Denman et al.
7,086,805 B2 8/2006 Smith et al.
7,306,397 B2 * 12/2007 Albritton ..... E01F 15/0423 188/375
7,926,790 B2 4/2011 James
8,360,400 B2 1/2013 Leonhardt et al.
8,424,849 B2 4/2013 James
9,051,698 B1 6/2015 Anghileri et al.
2006/0011900 A1 * 1/2006 Ochoa ..... E01F 15/0423 256/13.1
2008/0224114 A1 * 9/2008 Cheng ..... E01F 15/0423 256/19
2013/0140510 A1 6/2013 James et al.

FOREIGN PATENT DOCUMENTS

FR 2650010 A1 * 1/1991 ..... E01F 15/025

* cited by examiner

*Primary Examiner* — Jonathan Masinick
(74) *Attorney, Agent, or Firm* — Thomas R. Lampe

(57) ABSTRACT

A guardrail crash absorbing assembly including two relatively slidable rail panels, each having top and bottom edge portions, and a braking structure attached to one of the rail panels engaging and deforming an edge portion of the other rail panel to dissipate kinetic energy and absorb impact forces.

16 Claims, 5 Drawing Sheets

10
12
14
16
18
20
22
24
26
28
30
32
34
40
44
46

GUARDRAIL CRASH ABSORBING ASSEMBLY

TECHNICAL FIELD

This invention relates to apparatus for absorbing energy when impacted by a vehicle. More specifically, the apparatus relates to a guardrail crash absorbing assembly utilized as a barrier which dissipates the energy of moving vehicles impacting an end impact structure of the assembly.

BACKGROUND OF THE INVENTION

It is well known to provide impact absorbing systems, often called "crash attenuators" or "crash cushions" in association with guardrails. The guardrails may be disposed along roadways or utilized adjacent to rigid structures such as pillars, bridge abutments, lighting poles and the like for the purpose of absorbing vehicle impact energy and minimizing the effects of impact on the vehicle, the vehicle occupants and any ancillary structure being protected.

There are many forms and types of energy absorbing barriers. The following patent documents are believed to be representative of a variety of crash attenuator systems including patents disclosing such systems on or in connection with guardrails employing a plurality of overlapping side panels which are relatively movable and telescope in the event of a vehicle collision with an end of the structure: U.S. Pat. No. 4,838,523, issued Jun. 13, 1989, U.S. Pat. No. 4,655,434, issued Apr. 7, 1987, U.S. Pat. No. 4,739,971, issued Apr. 26, 1988, U.S. Pat. No. 7,926,790, issued Apr. 19, 2011, U.S. Pat. No. 8,360,400, issued Jan. 29, 2013, U.S. Pat. No. 8,424,849, issued Apr. 23, 2013, U.S. Pat. No. 4,330,106, issued May 18, 1982, U.S. Pat. No. 7,086,805, issued Aug. 8, 2006, U.S. Pat. No. 5,851,005, issued Dec. 22, 1998, U.S. Pat. No. 6,811,144, issued Nov. 2, 2004, U.S. Pat. No. 9,051,698, issued Jun. 9, 2015, and Patent Application Publication No. US 2013/0140510, published Jun. 6, 2013.

As will be seen below, the present invention incorporates sliders of a distinctive character in operative association with overlapping rail panels of a crash absorbing guardrail panel assembly.

The use of sliders per se are known generally in the crash absorbing guardrail art, but the structural combination and manner of operation of the present invention differ considerably from such known impact slider arrangements.

U.S. Pat. No. 7,926,790, issued Apr. 19, 2011, shows an impact slider assembly for a guardrail including a slider connected to a first rail and a slider substantially surrounding the first rail, so that in use, the slider gathers and retains the first and any subsequent rails which telescopically overlap with each other during an impact.

U.S. Pat. No. 8,424,849, issued Apr. 23, 2003, discloses an impact slider assembly for a guardrail which includes: a slider mechanism attached to a first rail and a second rail which substantially conforms with a rail profile; and an integral means for attachment to the first rail, wherein the slider mechanism gathers telescoping rails while substantially maintaining the strength of the rails in a fully redirecting manner.

DISCLOSURE OF INVENTION

The present invention relates to a guardrail crash absorbing assembly.

The assembly includes an elongated first rail panel having a first rail panel front portion, a first rail panel rear portion, a first rail panel top edge portion and a first rail panel bottom edge portion.

An elongated second rail panel is also incorporated in the assembly, the elongated second rail panel having a second rail panel front portion, a second rail rear portion, a second rail panel top edge portion, and a second rail panel bottom edge portion. The first rail panel rear portion and the second rail panel front portion are in side by side, overlapping relationship.

An impact end structure is operatively associated with the first rail panel and responsive to vehicle frontal impact on the end terminal to move the first rail panel rearwardly lengthwise along the second rail panel.

A braking structure is attached to the first rail panel engaging and deforming at least one of the second rail panel top edge portion and the second rail panel bottom edge portion during rearward lengthwise movement of said first rail panel relative to the second rail panel to dissipate kinetic energy of the first rail panel sliding along the second rail panel and absorb impact forces.

Other features, advantages and objects of the present invention will become apparent with reference to the following description and accompanying drawings.

MODES FOR CARRYING OUT THE INVENTION

Figures 1, 2, 3:
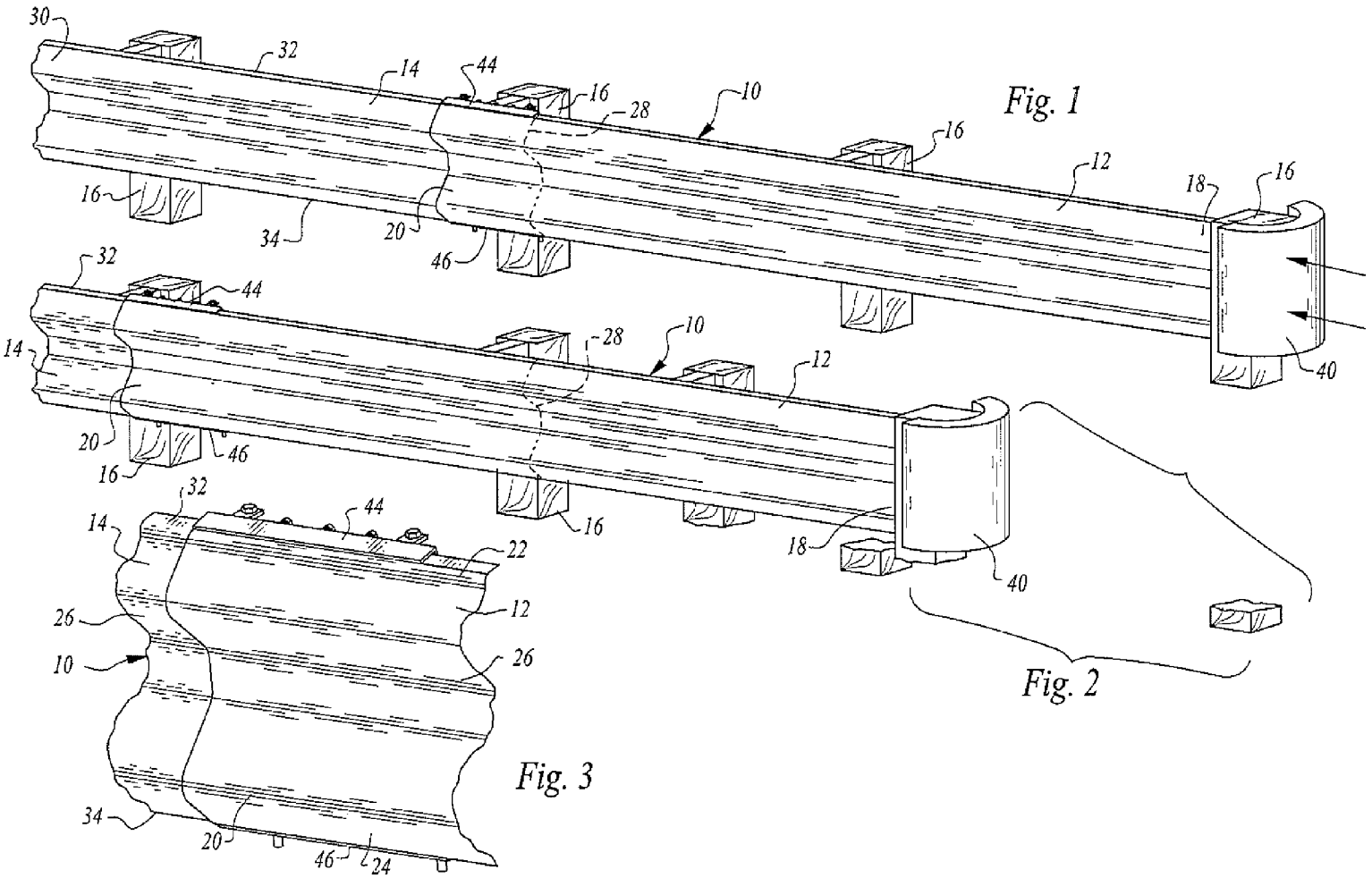
FIG. 1 is a perspective view illustrating a portion of a guardrail incorporating a guardrail crash absorbing assembly constructed in accordance with the teachings of the present invention including inner and outer rail panels and an impact end structure in the form of an end terminal positioned in front of the outer rail panel, the structural elements being in the relative positions normally assumed thereby prior to an application of an endwise force on the end terminal as depicted by arrows.
FIG. 2 is a view similar to FIG. 1, but illustrating the condition of the guardrail crash absorbing assembly after the end terminal has been impacted by a vehicle.
FIG. 3 is an enlarged, outer side perspective view illustrating overlapping portions of rail panels of the assembly in the condition shown in FIG. 1 and sliders attached to the outer rail panel, the sliders including housings receiving top and bottom edge portions of the inner rail panel.
Figure 4:
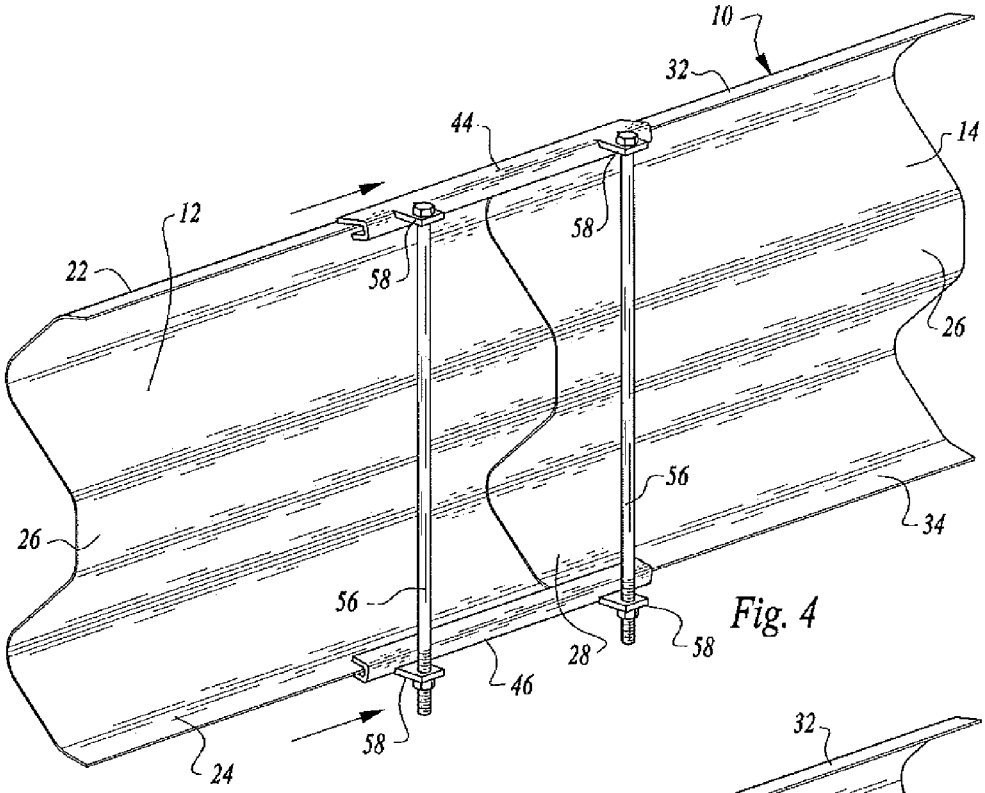
FIG. 4 is a view similar to FIG. 3 illustrating the structural components as observed from the inner side of the guardrail crash absorbing assembly and depicting the normal relative positions of the structural components prior to slidable movement therebetween resulting from an endwise vehicle collision.

Referring to FIGS. 1-11 of the drawings, a guardrail crash absorbing assembly 10 constructed in accordance with the teachings of the present invention is illustrated.

The assembly 10 includes an elongated outer rail panel 12 and an elongated inner rail panel 14. The rail panels are conventional W-beams. As also is conventional, the rail panels are supported by support posts 16, suitably formed of wood for example, which are separated from one another and spaced along the guardrail.

The outer rail panel 12 has a panel front portion 18 and a panel rear portion 20. Outer rail panel 12 also has a rail panel top edge portion 22 and a rail panel bottom edge portion 24. The top and bottom edge portions are outermost panel segments of the W-beam, a W-beam central generally curved portion 26 being located therebetween, as is conventional with respect to W-beams.

Elongated inner rail panel 14, has a rail panel front portion 28 and a rail panel rear portion 30, a rail panel top edge portion 32 and a rail panel bottom edge portion 34. A curved central portion 26 is located between top edge portion 32 and bottom edge portion 34 of the W-beam construction.

The panel rear portion 20 of outer rail panel 12 and the panel front portion 28 of rail panel 14 are in side by side, overlapping relationship.

An impact end structure in the form of an end terminal 40 is operatively associated with the outer rail panel 12 and responsive to vehicle frontal impact on the end terminal to move the outer rail panel rearwardly lengthwise along the inner rail panel. In the arrangement illustrated, end terminal 40 is located at forwardmost support post 16 supporting the outer rail panel front portion 18.

In FIG. 1, arrows show a force being initially applied to the end terminal 40 by an endwise vehicle collision, the vehicle not being illustrated. The crash will break the post to which the outer rail panel 12 is attached and cause the outer rail panel to move rearwardly lengthwise along the inner rail panel 14, also breaking subsequent posts encountered during movement.

The guardrail crash absorbing assembly illustrated in FIGS. 1-11 includes a braking structure attached to the outer rail panel engaging and deforming at least one of the second rail panel top edge portion and the second rail panel bottom edge portion during rearward lengthwise movement of the outer rail panel relative to the inner rail panel to dissipate kinetic energy of the outer rail panel sliding along the inner rail panel and absorb impact forces.

The braking structure of the assembly illustrated in FIGS. 1-11 includes two sliders 44, 46 which are of like configuration. Slider 44 is attached to the top edge portion 22 of outer rail panel 12 and slider 46 is attached to bottom edge portion 24 of outer rail panel 12.

Each of the sliders 44, 46 includes a bracket-like housing 50 welded or otherwise fixedly attached to the top and bottom edge portions 22, 24 and defining an elongated recess 52 receiving the top and bottom edge portions 32, 34 of elongated inner rail panel 14.

The braking structure further includes a forming structure at each housing at the location of the elongated recess exerting forces on the inner rail panel edge portions 32, 34 during slidable movement of the outer rail panel relative to the inner rail panel to work and change the shapes of the inner panel top edge portion 32 and the bottom edge portion 34.

The braking structure additionally includes an elongated spacer and stabilizing structure in the form of spacer rods 56 extending between and secured to the housings 50. The elongated spacer and stabilizing structure additionally includes brackets 58 attached to and projecting from the housings and connected to the spacer rods by nuts.

The topmost housing 50 attached to outer rail panel 12 is positioned above the lower housing 50 whereby forces exerted by the forming structures on the inner rail panel bottom edge portion and the inner panel top edge portion are exerted substantially simultaneously. The inner rail panel is not deformed between the rail panel top edge portion 32 and bottom edge portion 34; that is, not at the central portion 26.

In the embodiment disclosed in FIGS. 1-11, the forming structure located at the housings is operable to roll or bend over the associated inner rail panel edge portion so that the segment thereof is folded over an adjoining segment of the second rail panel edge portion. This operation may perhaps best be seen with reference to FIG. 5 and also FIGS. 6-11, the latter showing the lowermost housing 50 receiving bottom edge portion 34. It is to be understood that the same structure and operation exist at uppermost housing 50 receiving top edge portion 32.

Figure 5:
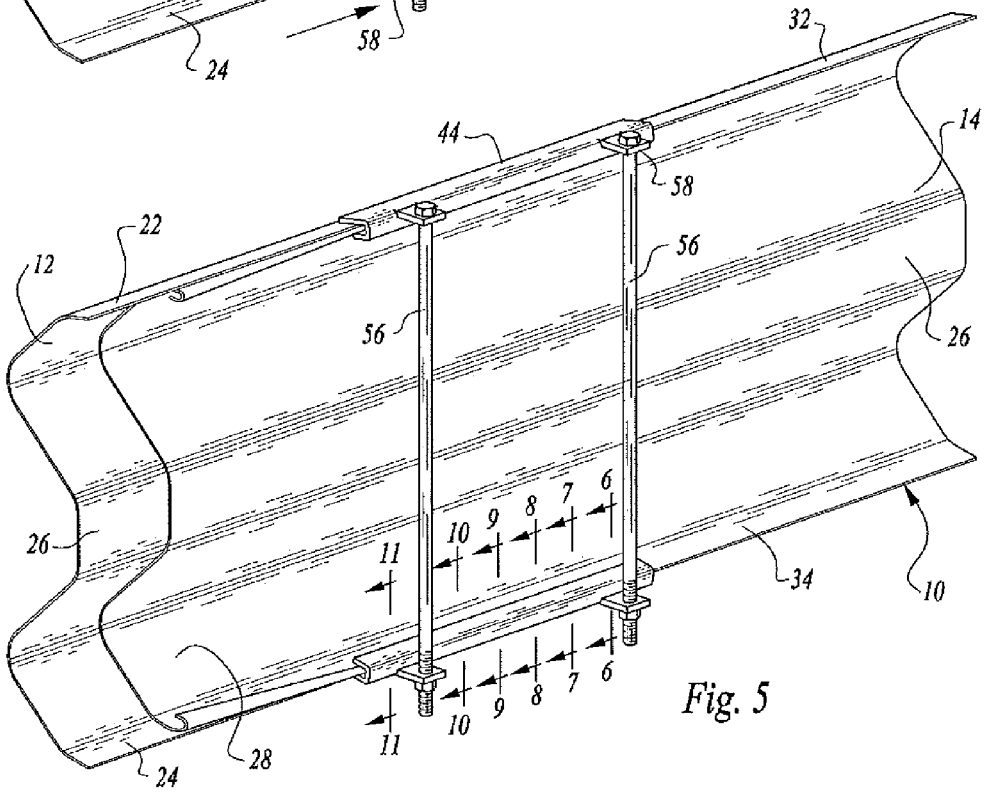
FIG. 5 is a view similar to FIG. 4, but showing the outer rail panel sliding in the direction of the arrows caused by vehicle collision.
Figure 6:
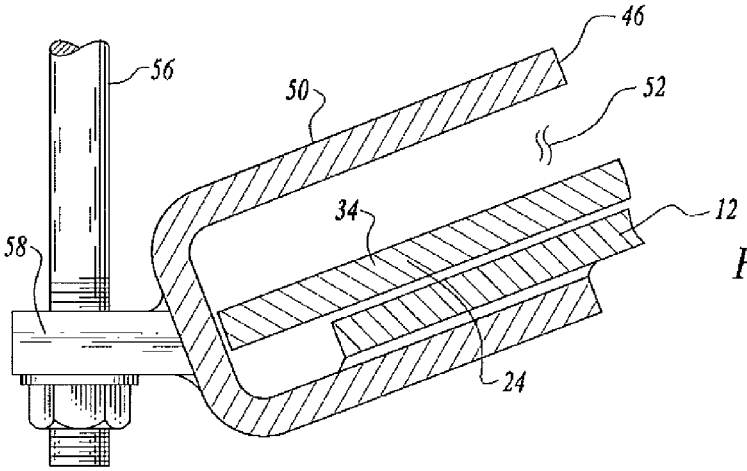
FIGS. 6-11 are greatly enlarged, cross-sectional views of a housing and forming structure of the slider of the invention in the process of exerting forces on the inner rail panel bottom edge portion in sequential fashion to deform and work the inner rail panel bottom edge portion and fold over the bottom edge portion.
Figure 7:
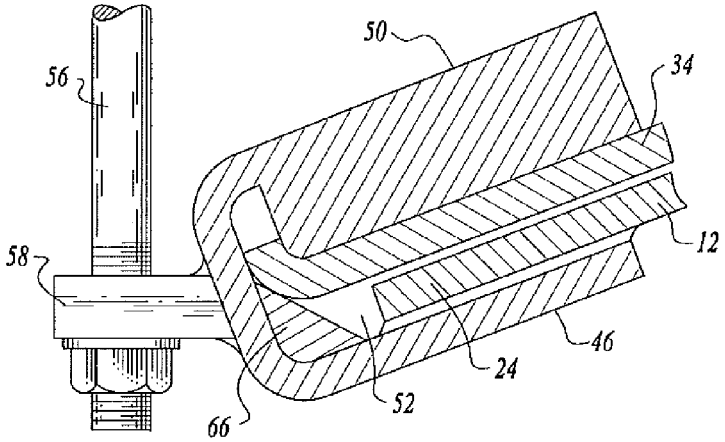
Figure 8:
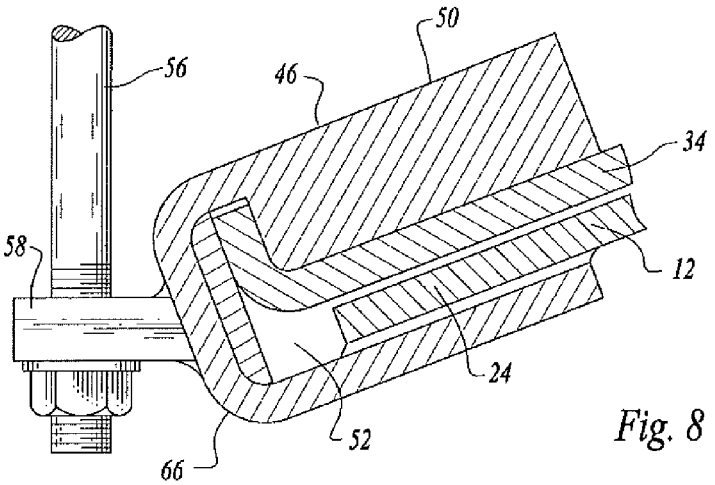
Figure 9:
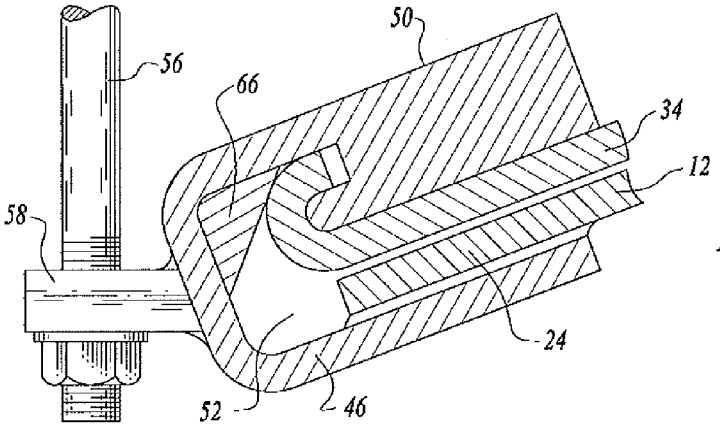
Figure 10:
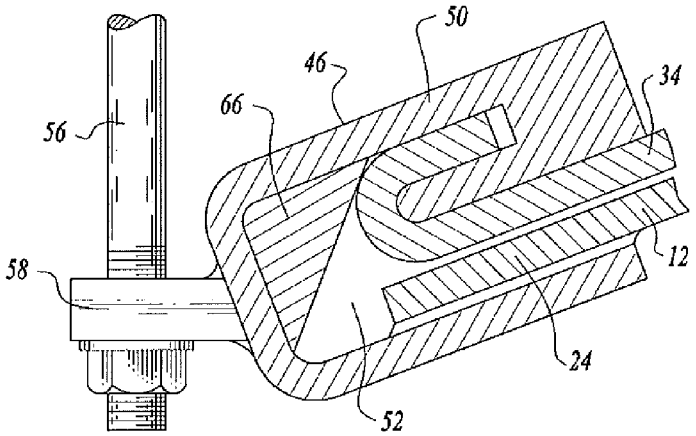
Figure 11:
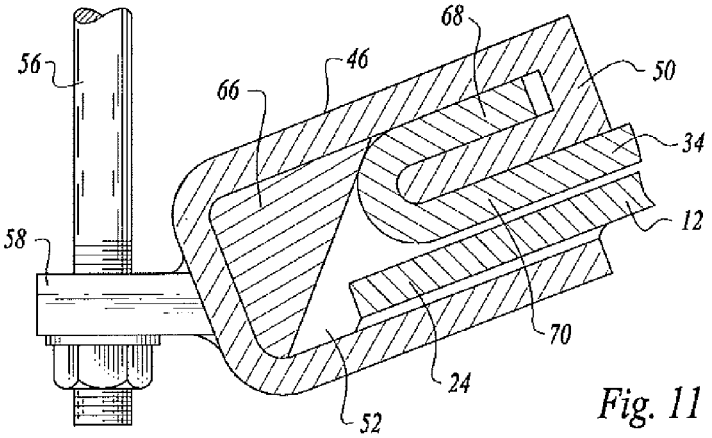
Figure 12:
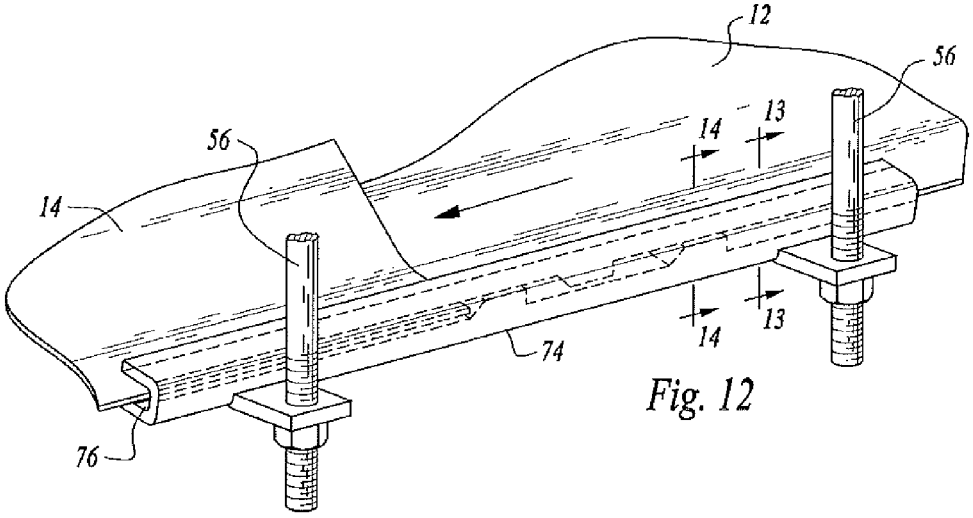
FIG. 12 is an enlarged, perspective view illustrating selected components including housing and forming structure of an alternative embodiment of the invention in operative association with the bottom edge portions of inner and outer rail panels.
Figure 13:
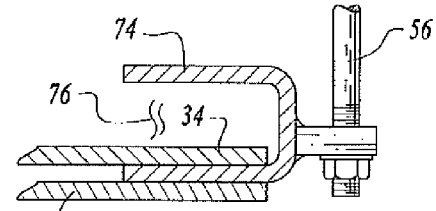
FIG. 13 is an enlarged, cross-sectional view taken along the line 13-13 in FIG. 12.
Figure 14:
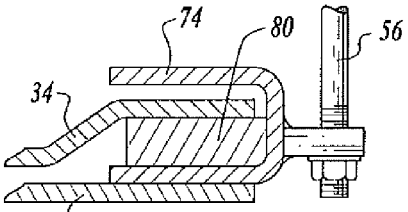
FIG. 14 is an enlarged, cross-sectional view taken along the line 14-14 in FIG. 12.
Figure 15:
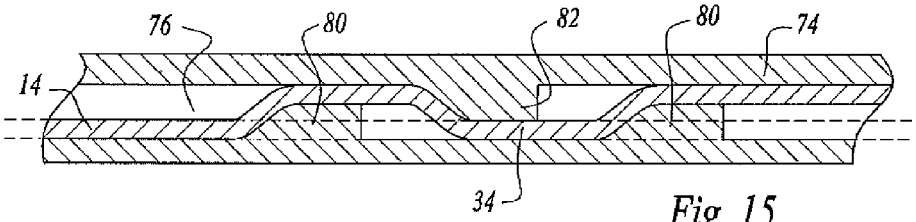
FIG. 15 is an enlarged, cross-sectional view of a segment of the bottom edge portion of the inner rail panel passing through the housing and forming structure of the embodiment of FIG. 12.

FIG. 5 shows the outer rail panel 12 having been slid along the inner rail panel 14, a portion of the latter having already passed through the housings 50 and projecting therefrom. The top and bottom edge portions 32 and 34 that have passed through the housing have been rolled or folded over and that action has partially dissipated kinetic energy of the outer rail panel sliding along the inner rail panel and absorbed impact forces. This action will continue to take place during any additional relative sliding.

The folding or rolling over operation has been accomplished by a forming structure in each of the housings and in a manner sequentially carried out as illustrated in FIGS. 6-11. The folding over operation is accomplished by forming structure including a ramp 66 in conjunction with inner wall surfaces of the housing or bracket 50, both of which vary in configuration along the length of the housing to engage the rail panel edge portion received by the housing and bend it to roll or fold over to form a segment 68 folded over an adjoining segment 70. See FIG. 11.

FIGS. 12-17 illustrate an alternative arrangement for working and deforming an inner rail panel edge portion. Only the lower or bottom housing 74 of such an arrangement is illustrated. Rods 56 extend to an upper housing 74 (not shown). Housing 74 has an elongated recess 76 receiving the bottom edge portion 34 of inner rail panel 14. The housing is welded or otherwise secured to the outer rail panel in the manner indicated above with respect to the first embodiment.

In this arrangement the forming structure includes a plurality of ramps defining a serpentine or tortuous pathway for the inner rail panel bottom edge portion during relative slidable movement between the inner and outer rail panels. Any desired number of ramps may be deployed along the length of the housing.

Figure 16:
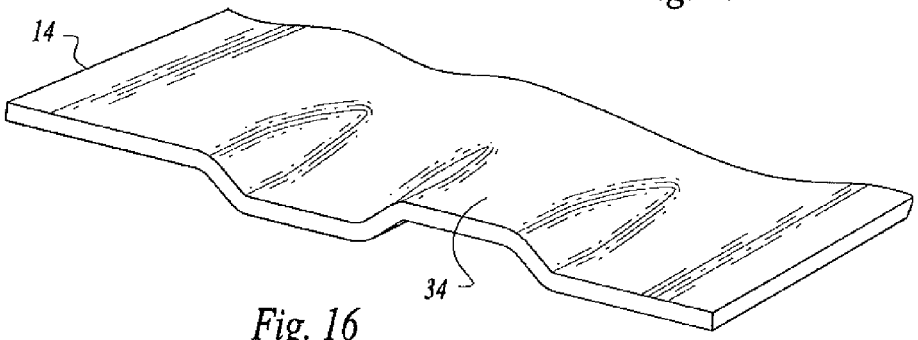
FIG. 16 is an enlarged, perspective view showing the segment of the bottom edge portion shown in FIG. 15 as deformed by the forming structure of FIG. 15.
Figure 17:
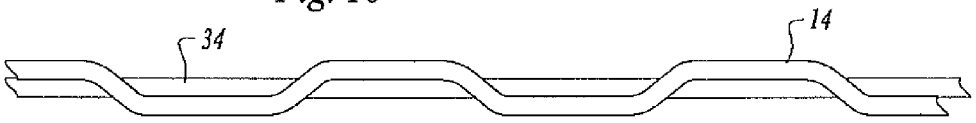
FIG. 17 is a side, elevation view of the deformed bottom edge portion segment shown in FIG. 16.

In the embodiment illustrated two ramps 80 project from the inner housing wall surface in a generally upward direction and one ramp 82 projects in a downward direction between the ramps 80. The ramps 80, 82 are offset with respect to one another and define nips through which the inner rail panel edge portion passes during slidable movement of the outer rail panel relative to the inner rail panel. Thus, rearward lengthwise movement of the outer rail panel relative to the inner rail panel dissipates kinetic energy by working the metal of the outer rail panel as it slides along the inner rail panel and absorbs impact forces. FIGS. 16 and 17 show the condition of the inner rail panel bottom edge portion segment in the tortuous path.

It is to be understood that the present invention is applicable not only to W-beams but also to guardrail constructions in general, including thrie beam or quad and box beam. Furthermore, the invention is applicable to guardrail end impact structures other than end terminals.

The invention claimed is:

1. A guardrail crash absorbing assembly comprising:

an elongated first rail panel having a first rail panel front portion, a first rail panel rear portion, a first rail panel top edge portion and a first rail panel bottom edge portion;

an elongated second rail panel having a second rail panel front portion, a second rail panel rear portion, a second rail panel top edge portion, and a second rail panel bottom edge portion, said first rail panel rear portion and said second rail panel front portion being in side by side, overlapping relationship;

an end impact structure operatively associated with said first rail panel and responsive to vehicle frontal impact on the end impact structure to move said first rail panel rearwardly lengthwise along said second rail panel; and a braking structure attached to said first rail panel engaging and deforming at least one of said second rail panel top edge portion and said second rail panel bottom edge portion during rearward lengthwise movement of said first rail panel relative to said second rail panel to dissipate kinetic energy of said first rail panel sliding along the second rail panel and absorb impact forces, said braking structure including a housing attached to said first rail panel defining an elongated recess for receiving either said second rail panel top edge portion or said second rail panel bottom edge portion, and said braking structure further including a forming structure at the location of the elongated recess exerting forces on the second rail panel edge portion disposed therein to work and change the shape thereof during movement of said first rail panel relative to said second rail panel.

2. The guardrail crash absorbing assembly according to claim 1 wherein said forming structure includes at least one inner wall surface of said housing engaged by a second rail panel edge portion when relative slidable movement between said first rail panel and said second rail panel takes place.

3. The guardrail crash absorbing assembly of claim 2 wherein said forming structure includes at least one ramp cooperable with said at least one inner wall surface to bend the second rail panel edge portion so that a segment of the second rail panel edge bottom is folded over an adjoining segment of the second rail panel edge portion.

4. The guardrail crash absorber according to claim 3 wherein the shapes of said at least one ramp and said at least one inner wall surface vary along at least a portion of the length of said housing.

5. The guardrail crash absorber according to claim 2 wherein said forming structure includes a plurality of ramps sequentially engaged by a second rail panel edge portion during relative slidable movement between said first rail panel and said second rail panel to form curvatures in said second rail panel edge portion.

6. The guardrail crash absorber according to claim 1 wherein said panel structure comprises a plurality of ramps offset with respect to one another and defining nips through which said second rail panel edge portion passes during slidable movement of said first rail panel relative to said rail panel.

7. The guardrail crash absorber according to claim 6 wherein said ramps define a tortuous path of movement.

8. A guardrail crash absorbing assembly comprising:

an elongated first rail panel having a first rail panel front portion, a first rail panel rear portion, a first rail panel top edge portion and a first rail panel bottom edge portion;

an elongated second rail panel having a second rail panel front portion, a second rail panel rear portion, a second rail panel top edge portion, and a second rail panel bottom edge portion, said first rail panel rear portion and said second rail panel front portion being in side by side, overlapping relationship;

and end impact structure operatively associated with said first rail panel and responsive to vehicle frontal impact on the end impact structure to move said first rail panel rearwardly lengthwise along said second rail panel; and a braking structure attached to said first rail panel engaging and deforming at least one of said second rail panel top edge portion and said second rail panel bottom edge portion during rearward lengthwise movement of said first rail panel relative to said second rail panel to dissipate kinetic energy of said first rail panel sliding along the second rail panel and absorb impact forces, said braking structure including a housing attached to said first rail panel defining an elongated recess receiving the second rail panel top edge portion and a forming structure at the location of said elongated recess exerting forces on said second rail panel top edge portion during movement of said first rail panel relative to the second rail panel to work the second rail top edge portion and change the shape of the second rail panel top edge portion.

9. A guardrail crash absorbing assembly comprising:

an elongated first rail panel having a first rail panel front portion, a first rail panel rear portion, a first rail panel top edge portion and a first rail panel bottom edge portion;

an elongated second rail panel having a second rail panel front portion, a second rail panel rear portion, a second rail panel top edge portion, and a second rail panel bottom edge portion, said first rail panel rear portion and said second rail panel front portion being in side by side, overlapping relationship;

an end impact structure operatively associated with said first rail panel and responsive to vehicle frontal impact on the end impact structure to move said first rail panel rearwardly lengthwise along said second rail panel; and a braking structure attached to said first rail panel engaging and deforming at least one of said second rail panel top edge portion and said second rail panel bottom edge portion during rearward lengthwise movement of said first rail panel relative to said second rail panel to dissipate kinetic energy of said first rail panel sliding along the second rail panel and absorb impact forces, said braking structure including a housing attached to said first rail panel defining an elongated recess receiving the second rail panel bottom edge portion and a forming structure at the location of the elongated recess exerting forces on said second rail panel bottom edge portion during movement of said first rail panel relative to the second rail panel to work the second rail panel bottom edge portion and change the shape of the second rail panel bottom edge portion.

10. A guardrail crash absorbing assembly comprising:

an elongated first rail panel having a first rail panel front portion, a first rail panel rear portion, a first rail panel top edge portion and a first rail panel bottom edge portion;

an elongated second rail panel having a second rail panel front portion, a second rail panel rear portion, a second rail panel top edge portion, and a second rail panel bottom edge portion, said first rail panel rear portion and said second rail panel front portion being in side by side, overlapping relationship;

an end impact structure operatively associated with said first rail panel and responsive to vehicle frontal impact on the end impact structure to move said first rail panel rearwardly lengthwise along said second rail panel; and a braking structure attached to said first rail panel engaging and deforming at least one of said second rail panel top edge portion and said second rail panel bottom edge portion during rearward lengthwise movement of said first rail panel relative to said second rail panel to dissipate kinetic energy of said first rail panel sliding along the second rail panel, said braking structure including a first housing attached to the first rail panel top edge portion and a second housing attached to the first rail panel bottom edge portion, said first housing defining an elongated recess receiving said second rail panel top edge portion, and said second housing defining an elongated recess for receiving said second rail panel bottom edge portion, said braking structure additionally including forming structures at the locations of said elongated recesses exerting forces on the second rail panel top edge portion and the second rail panel bottom edge portion during slidable movement of said first rail panel relative to the second rail panel to work and change the shapes of the second rail panel top edge portion and the second rail bottom edge portion.

11. The guardrail crash absorbing assembly according to claim 10 wherein said braking structure additionally includes an elongated spacer and stabilizing structure extending between and secured to said first housing and said second housing.

12. The guardrail crash assembly according to claim 11 wherein said elongated spacer and stabilizing structure includes a plurality of spacer rods.

13. The guardrail crash assembly according to claim 12 wherein said elongated spacer and stabilizing structure additionally includes brackets attached to and projecting from said first and second housings and connected to said spacer rods.

14. The guardrail crash absorbing assembly according to claim 10 wherein said first housing is positioned above said second housing whereby forces exerted by said forming structures on the second rail panel top edge portion and the second rail panel bottom edge portion are exerted substantially simultaneously.

15. The guardrail crash absorbing assembly according to claim 14 wherein the first and second housings are spaced from one another whereby said second rail panel is not deformed between said second rail top edge portion and said second rail bottom edge portion during slidable movement of said first rail panel relative to said second rail panel.

16. The guardrail crash absorber according to claim 10 wherein said guardrail panel and said second rail panel are W-beams having a central curved portion, said first and second housings spaced from and disposed on opposite sides of the central curved portion of said first rail panel.

* * * * *